US006377158B1

(12) United States Patent
Yu

(10) Patent No.: US 6,377,158 B1
(45) Date of Patent: Apr. 23, 2002

(54) PUSH BUTTON CURRENT CUT-OFF SAFETY SWITCH

(76) Inventor: Tsung-Mou Yu, No. 4, Alley 2, Lane 23, Sec. 3, Pa-Te Raod, Pan-Chiao City, Taipei (TW)

( * ) Notice: Subject to any disclaimer, the term of this patent is extended or adjusted under 35 U.S.C. 154(b) by 0 days.

(21) Appl. No.: 09/500,618

(22) Filed: Feb. 9, 2000

(30) Foreign Application Priority Data

Feb. 12, 1999 (CN) ..... 88202522 U

(51) Int. Cl.[7] ..... H01H 37/02; H01H 37/32; H01H 37/46; H01H 37/52

(52) U.S. Cl. ..... 337/37; 337/39; 337/59; 337/85; 337/112; 337/113

(58) Field of Search ..... 337/59, 66, 79, 337/76, 53, 67–69, 74, 75, 91, 39, 85, 112, 113, 140, 334, 345; 200/553–557

(56) References Cited

U.S. PATENT DOCUMENTS

| | | | | | |
|---|---|---|---|---|---|
| 2,955,177 | A | * | 10/1960 | Brackett | 200/116 |
| 4,068,203 | A | * | 1/1978 | Unger | 337/56 |
| 4,363,016 | A | * | 12/1982 | Unger | 337/56 |
| 4,704,594 | A | * | 11/1987 | Krasser | 337/66 |
| 4,780,697 | A | * | 10/1988 | Cobb, III et al. | 337/70 |
| 5,001,450 | A | * | 3/1991 | Wu | 337/68 |
| 5,153,552 | A | * | 10/1992 | Krasser | 337/66 |
| 5,157,369 | A | * | 10/1992 | Yao | 337/68 |
| 5,786,742 | A | * | 7/1998 | Yin | 337/66 |
| 5,854,585 | A | * | 12/1998 | Kingma | 337/367 |
| 5,936,505 | A | * | 8/1999 | Yu | 337/66 |
| 6,121,868 | A | * | 9/2000 | Chiang | 337/37 |
| 6,229,426 | B1 | * | 5/2001 | Lavado et al. | 337/57 |

FOREIGN PATENT DOCUMENTS

| | | | | |
|---|---|---|---|---|
| DE | 3313465 | A1 | * 10/1984 | 337/36 |
| FR | 2766007 | A1 | * 1/1999 | H01H/13/14 |

* cited by examiner

*Primary Examiner*—Leo P. Picard
*Assistant Examiner*—Anatoly Vortman
(74) *Attorney, Agent, or Firm*—Senniger, Powers, Leavitt & Roedel

(57) ABSTRACT

A push button current cut-off safety switch comprising a housing having an opening; a push button mounted within the housing and being fitted to said opening; a push rod being mounted below said push button and including a triangular passage and an insulating element; a spring being inserted into and compressed by the push rod; an interlinking rod having one end pivotally connected to the housing and the other end being connected to the triangular passage of the push rod; a first conductive plate; a second conductive plate being connected to the first conductive plate by a resilient plate such that the downward movement of the push rod electrically connects to the first and the second conductive plates and the upward movement of the push button disconnects the first and the second conductive plates; an alloy metal made of a shape memory alloy which is thermally deformable, said alloy metal being linked to the second conductive plate and connected to the interlinking rod; a third conductive plate being connected to the second conductive plate by the alloy metal; and whereby when the switch is at a closed circuit state and the current exceeds a predetermined current value, the alloy metal curves upward as a result of elevated temperature, and causes the interlinking rod to drive the insulating element to a position between the third conductive plate and the alloy metal.

8 Claims, 9 Drawing Sheets

PUSH BUTTON CURRENT CUT-OFF SAFETY SWITCH

BACKGROUND OF THE INVENTION

1. Field of the Invention

The present invention relates to a push button current cut-off safety switch, and in particular, to a safety switch applying the characteristics of thermal deformation of an alloy to automatically cut-off circuit when it is overloaded, so as to attain the purpose of safety.

2. Description of the Prior Art

FIG. 1 shows an exploded view of a prior art push button switch. When the push button 202 is in the top position of a housing before it is depressed, the contact 206 of a conductive plate 204 and the contact 210 of the connecting leg 208 are separated from each other. When the push button 202 is depressed, the protruded rod 212 of the push button 202 triggers the conductive plate 204 such that the contact 206 contacts with the contact 210.

Thus, the switch is shifted to a conductively connected state. However, this switch provides only the function of ON and OFF, it can not automatically cut off the circuit at a specified current value. As there is no automatic current breaking device in the switch, manual operation is required to shift from ON or OFF state. In order to automatically cut off the current supply to the circuit, there are different kinds of fuse devices available. However, it is not convenient to replace a fuse when it melts. Further, it is necessary to keep a number of fuses in stock for ready use.

In other conventional art, a safety device is employed after the circuit is opened such that by depressing a button thereof, the switch can be restored and ready to use. However, in this prior art, the circuit is very complicated as an additional safety device has to be installed. It is not economical due to greater costs of material, installation and fabrication.

U.S. Pat. No. 5,786,742 relates to a push button switch with an override interruption structure. Referring to FIGS. 1, 2 and 4 to 8 of the patent, the switch comprises a push button 1 connected to contacts 61, 62. When the push button 1 is depressed, the contacts 61, 62 respectively contact with the contacts 731 and 461 of a first conductive plate 73 and a second conductive plate 46 such that the switch is switched to the ON state. This switch employs a well-known mechanism such that when the button 1 is depressed, it remains in the pressed-down position, and the button 1 restores to its original position to open the circuit when the button 1 is depressed once again. In addition, the switch comprises a circuit cut-off device, and when the alloy 75 is overheated, it deforms and causes the push button 1 to be released. Thus the push button 1 restores to its original position, and the contacts are separated. The switch is changed from the ON state to the OFF state.

SUMMARY OF THE PRESENT INVENTION

Accordingly, the present invention relates to a push button current cut-off safety switch, wherein a current cut-off device is mounted within a switch and the shape of the switch is similar to a common switch. In normal operating condition, if the switch is first in a circuit "cut-off" state, a depression on the push button changes the "cut-off" state into an "ON" state.

It is another object of the present invention to provide a push button current cut-off safety switch, wherein, the alloy metal is a conducting element within the switch. In accordance with the present invention, if the current via the switch exceeds a specified current value, the alloy metal curves as the temperature increases, and causes an interlinking rod to move. One end of the interlinking rod is in combination with a triangular passage structure such that when an insulating element is pushed to the position between two contacts of the conductive circuit, the circuit becomes a "cut-off" circuit. The circuit can be restored to its "electrically conductive" state by depressing the push button once more when the alloy metal is cooled without using other tools or changing other elements such as fuse, etc. Thus, the present invention is very convenient to use.

It is yet another object of the present invention to provide a push button current cut-off safety switch, which is reliable while the manufacturing cost is low.

Another object of the present invention is to provide a push button current cut-off safety switch, which is a very safe and convenient device in application.

BRIEF DESCRIPTION OF THE DRAWINGS

The above characteristics and other features of the invention are made more apparent in the ensuring Detailed Description of the Invention when read in conjunction with the attached drawings, wherein.

DETAILED DESCRIPTION OF THE PREFERRED EMBODIMENT

Figure 1:
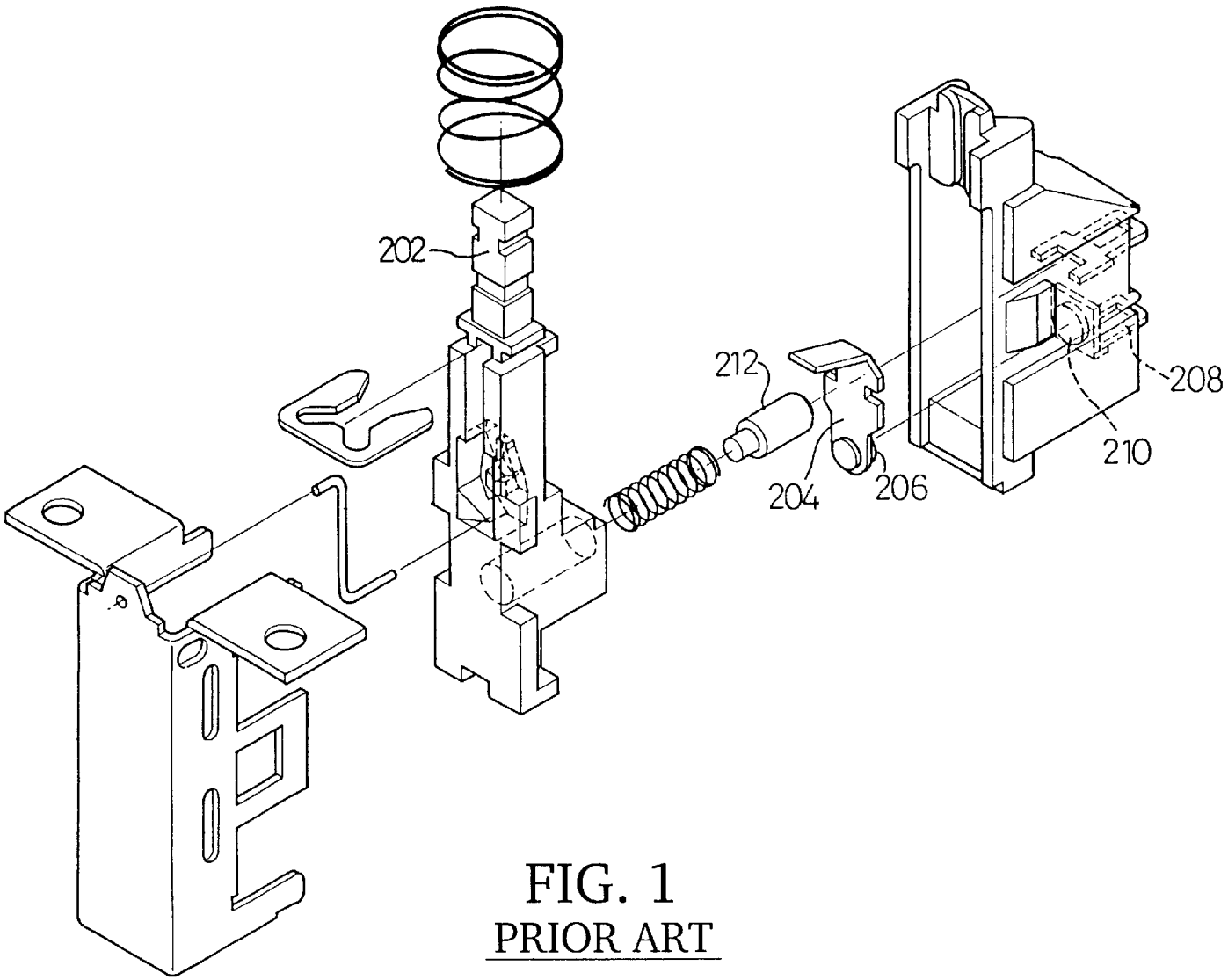
FIG. 1 PRIOR ART
FIG. 1 is a perspective exploded view of a conventional push button switch.
Figure 2:
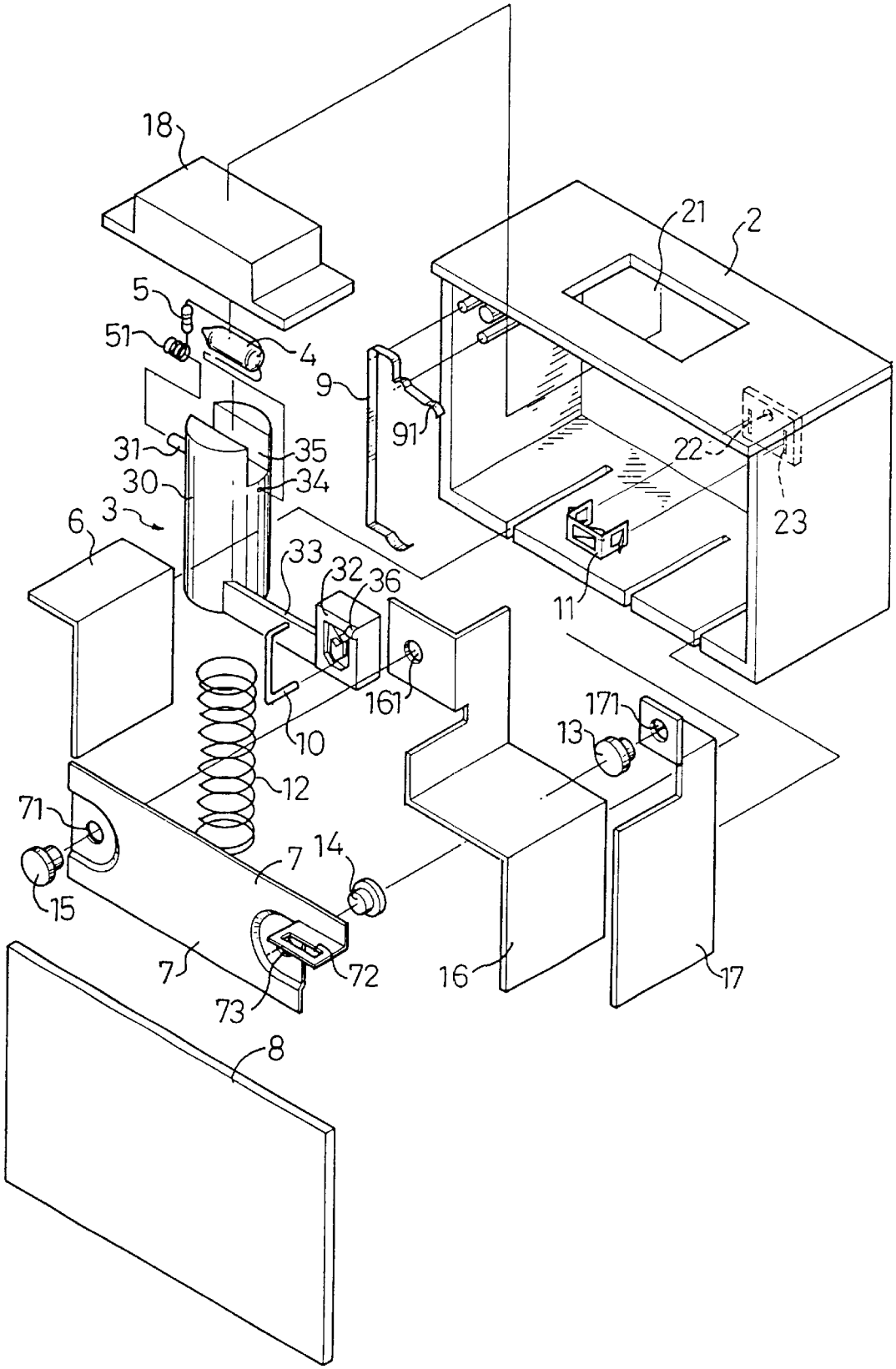
FIG. 2 is an exploded view of a push button current cut-off safety switch of the present invention.

Reference is made to FIGS. 2 to 9A, 9B and 9C, and in particular, to FIG. 2 of the present invention. FIG. 2 illustrates an exploded view of the push button current cut-off safety switch. The switch comprises a housing 2, a push button 18, a push rod 3, a leaf spring 11, a spring 12, an interlinking rod 10, a first conductive plate 6, a second conductive plate 16, a third conductive plate 17 and an alloy metal 7.

Figure 3A:
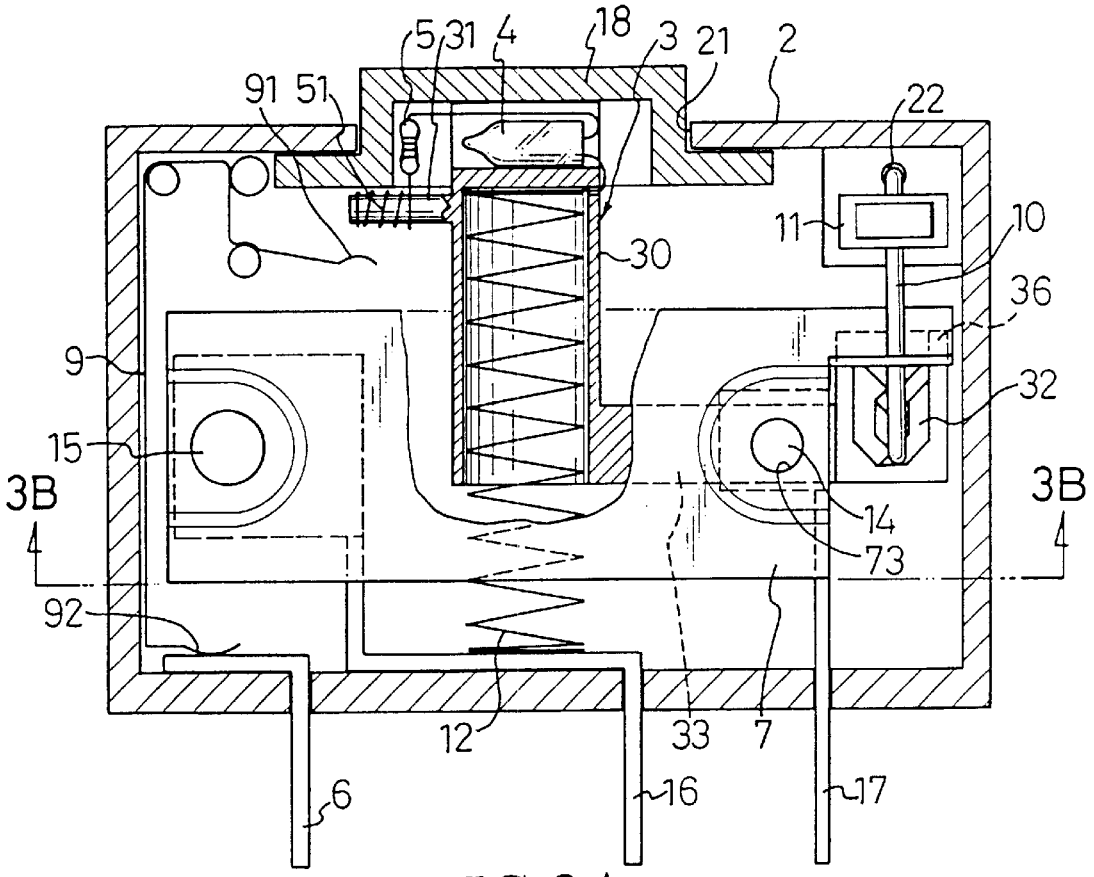
FIG. 3A is the switch in the "OFF" position in accordance with the present invention.

In accordance with the present invention, the above-mentioned elements are mounted within the housing 2 and are covered at one side of the housing 2 with a cover plate 8. The shape of the switch is shown in FIG. 3A.

An opening 21 is formed on the top of the housing 2 and the opening 21 is adaptable for the mounting of the push button 18. The push rod 3 is mounted below the push button 18 and comprises a push rod body 30, a press rod 31, a triangular passage 32 and an insulating element 33. The push rod body 30 is a hollow elongated body having a spring 12 inserted therein. A recess is formed at the top section of the press rod 31 to serve as a neon lamp fixing seat 35, on which neon lamp 4 is mounted. The neon lamp 4 has two connecting legs with one leg being inserted into an insertion hole 34 and being in contact with the top end of the spring 12 within the push rod 3. The other connecting leg is connected to a resistor 5. The resistor 5 has a connecting leg 51 which forms a helical shape and is mounted on the press rod 31 which extends from the lateral side of the push rod 3. The insulating element 33 is a thin plate protruding from the push rod 3, and a triangular passage 32 is formed at the end of the insulating element 33.

In accordance with the present invention, the first conductive plate 6, the second conductive plate 16 and the third conductive plate 17 are exposed to the outside of the housing 2. One end of a resilient plate 9 is in contact with the first conductive plate 6 and extends along the housing 2 to the lower section of the press rod 31, and keeps a small gap with the connecting leg 51 of the resistor 5 which is mounted on the press rod 31. The second conductive pate 16 is in contact with the spring 12. Thus, the second conductive plate 16 and the first conductive plate 6 are separated by a narrow gap.

One end of the alloy metal 7 and the second conductive plate 16 are fastened together by means of a rivet 15 in combination with the rivet hole 161 and hole 71. The other end of the alloy metal 7 is provided with a rivet hole 73 and a square hole 72. An upper contact 14 is provided at the rivet hole 73, and the third conductive plate 17 is also provided with a rivet hole 171. A lower contact 13 mounted at the rivet hole 171 is corresponding to the upper contact 14.

Figure 8:
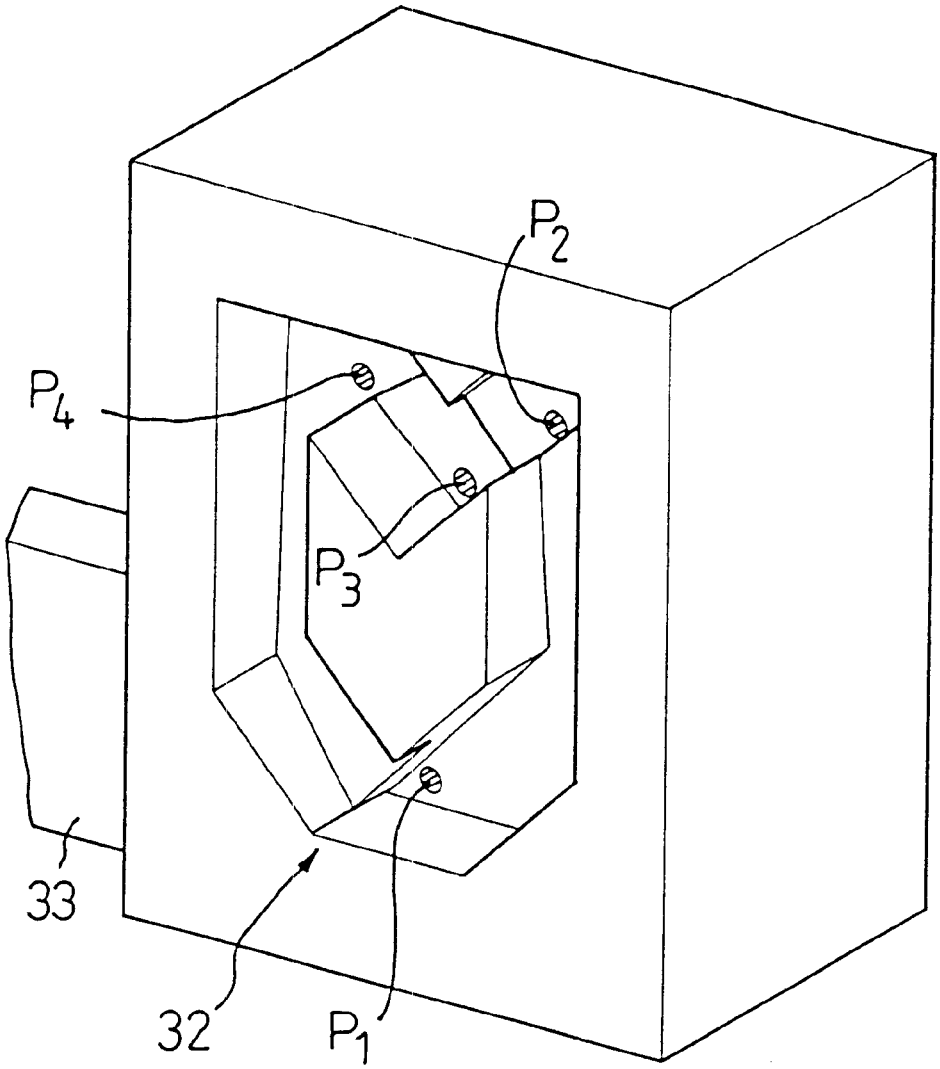
FIG. 8 shows the detailed structure of a triangular passage 32 of the present invention.

The free end of the insulating element 33 has a triangular passage 32, which is shown in FIG. 8. One end of the interlinking rod 10 is pivotally mounted at a hole 22 of the housing 2, and the other end of the interlinking rod 10 is positioned within the triangular passage 32. A leaf spring 11 is inserted into two slots 23 of the housing 2 and urges against interlinking rod 10 as shown in FIG. 3*a*. FIG. 8 shows four positions of $P_1$, $P_2$, $P_3$ and $P_4$, wherein the gradient increases from $P_1$ to $P_2$. At $P_2$, a downward step is formed. A step is formed between $P_2$ and $P_3$, and another step is also formed between $P_3$ and $P_4$. The gradient increases from $P_4$ to $P_1$, and at $P_1$, a downward step is formed. If the initial position of the lower end of the interlinking rod 10 is at $P_1$, and the triangular passage 32 moves upward, it will not move toward the position $P_4$ due to the blockage of the step, rather, it will move toward the position $P_2$. Similarly, if the push button 18 is released, the interlinking rod 10, moves along the contour of the triangular passage 32. As shown in the figures, the push button 18 moves counterclockwise.

Figure 3B:
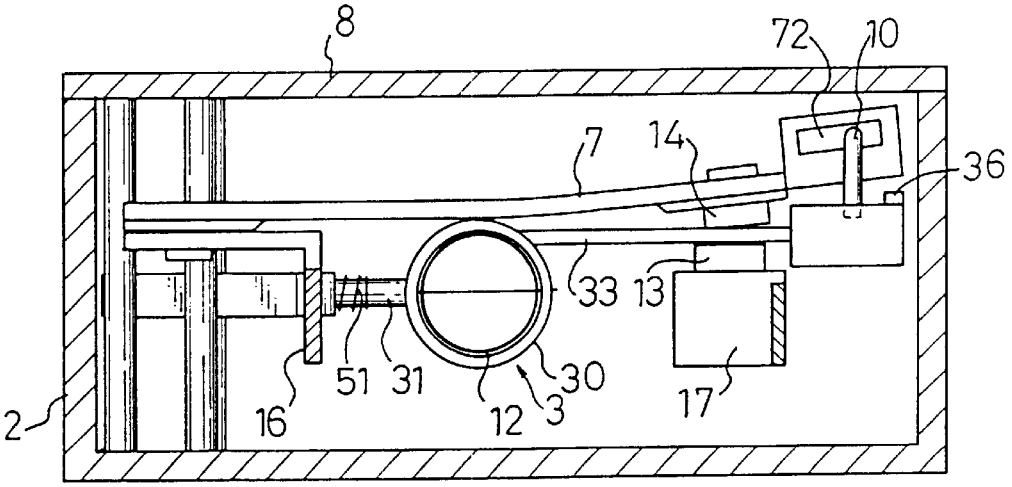
FIG. 3B is a cross-sectional view of the switch along line 3B—3B of FIG. 3A.

The operation of the switch of the present invention is described as follows:

As shown in FIG. 3A, when the switch is in OFF position (there is a gap between the connecting leg 51 and the resilient plate 9), it is an open circuit between the first conductive plate 6 and the second conductive plate 16. In addition, the insulating element 33 is positioned between the upper contact 14 and the lower contact 13 (as shown in FIG. 3B), accordingly, the circuit is opened between the third conductive plate 17 and the second conductive plate 16.

Figure 4A:
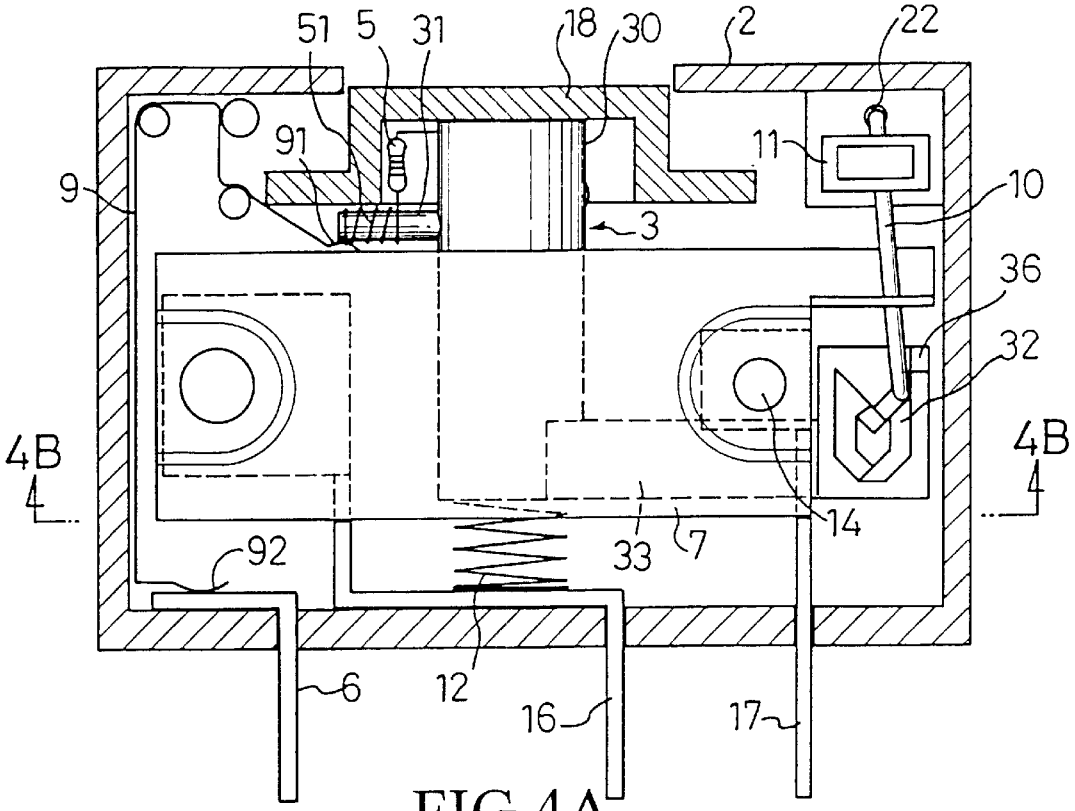
FIG. 4A shows the switch in the "OFF" position and the push button being depressed.
Figure 4B:
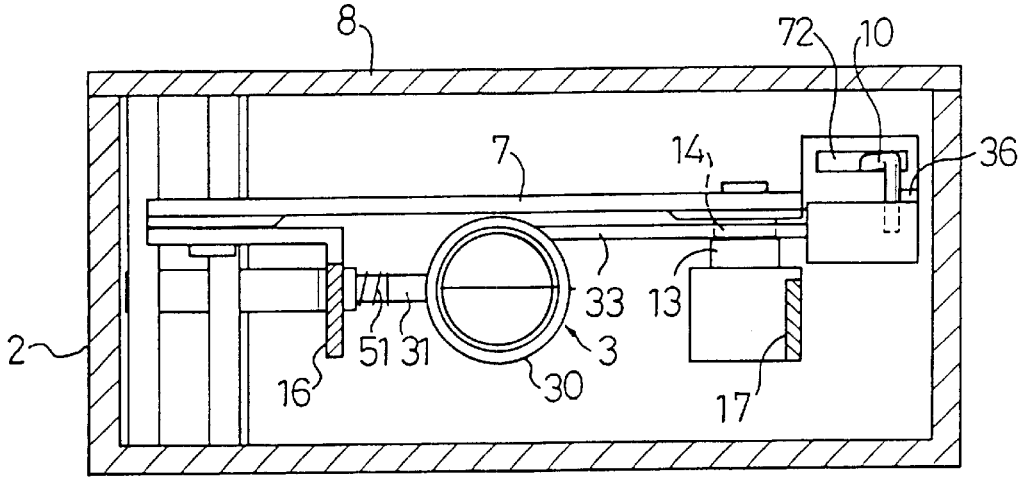
FIG. 4B is a cross-sectional view of the switch along line 4B—4B of FIG. 4A.

FIG. 4A shows the state in which the push button 18 is depressed. At this instance, the connecting leg 51 is in contact with the resilient plate 9 at the top contacting end 91. Thus, the first conductive plate 6 and the second conductive plate 16 are in communication. At the same time, the push rod 3 is pushed downward by the push button 18. The insulating element 33 moves downward and causes the upper contact 14 and the lower contact 13 contact with each other, and the third conductive plate 17 and the second conductive plate 16 are in communication. In addition, the lower end of the interlinking rod 10 at the position $P_1$ moves to the position $P_2$.

Figure 5A:
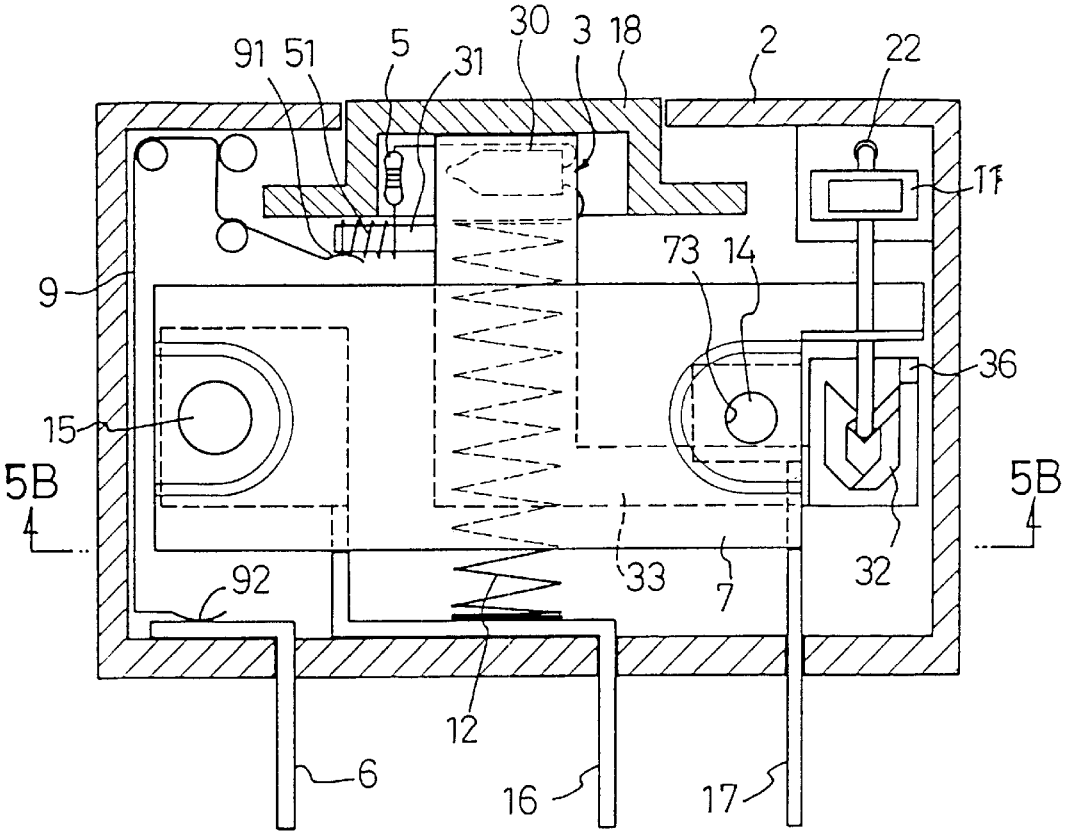
FIG. 5A shows the release of the push button of FIG. 4A into an "ON" position.
Figure 5B:
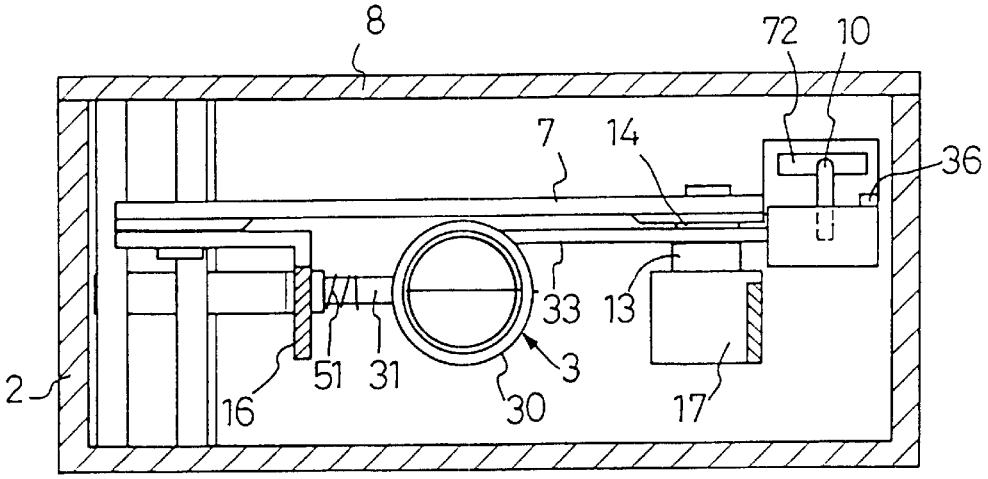
FIG. 5B is a cross-sectional view of the switch along line 5B—5B of FIG. 5A.

In accordance with the present invention, when the push button 18 is released, due to the pushing force of the spring 12, the push rod 3 is urged upward, and the lower end of the interlinking rod 10 moves to the position $P_3$ and remains at this position (as shown in FIG. 5A). At this point, the first conductive plate 6, the second conductive plate 16 and the third conductive plate 17 are in communication, and the neon lamp is lighted.

Figure 6A:
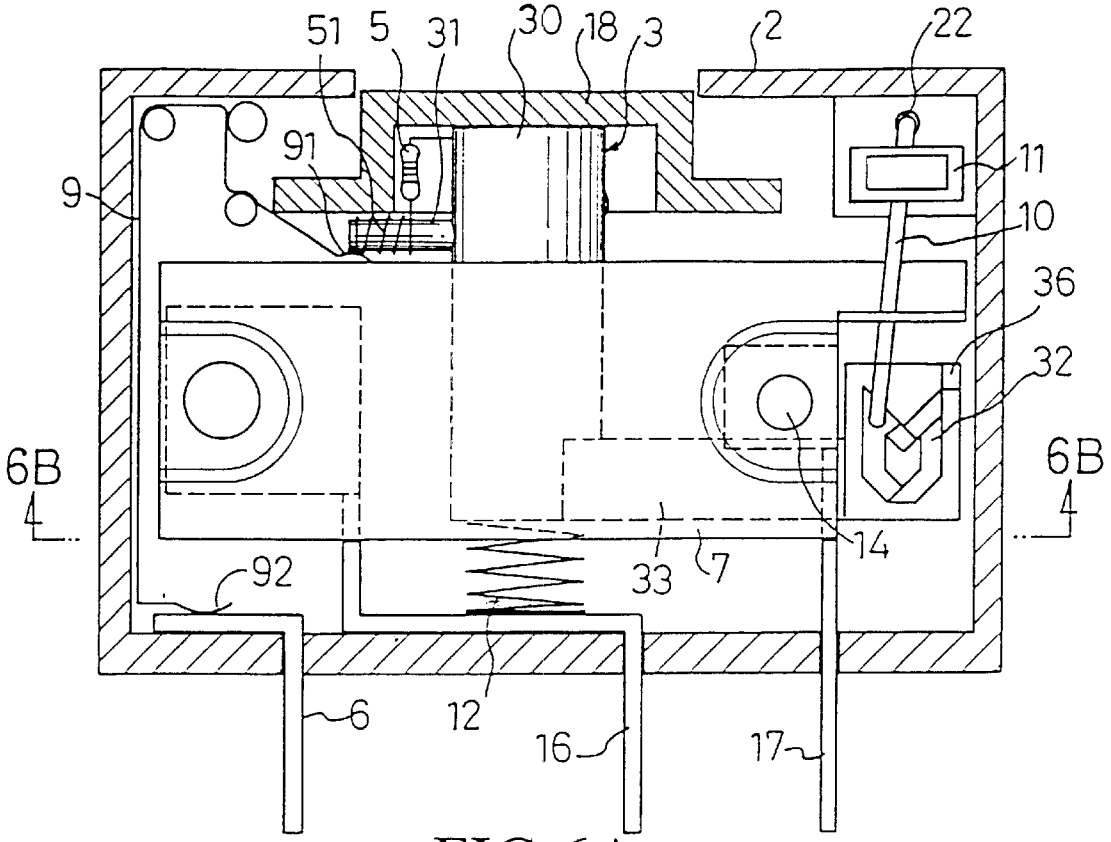
FIG. 6A illustrates the depression of the push button of FIG. 5A.
Figure 6B:
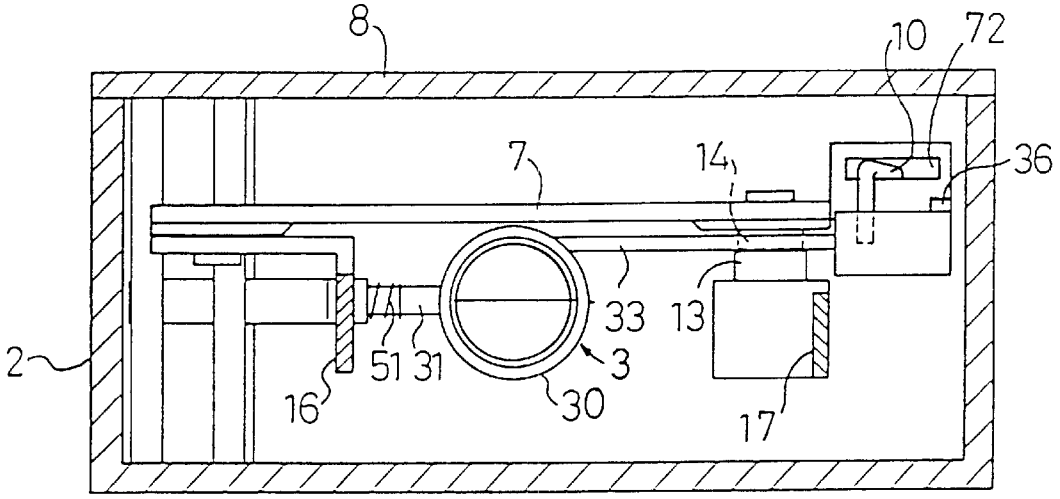
FIG. 6B is a cross-sectional view of the switch along line 6B—6B of FIG. 6A.

When the push button 18 is pressed again, as shown in FIG. 6A, the lower end of the interlinking rod 10 moves to the position $P_4$. When the push button 18 is released, due to the pushing force of the spring 12, the push rod 3 is urged upward and a protrusion 36 pushes the alloy metal 7 upward such that the insulating element 33 can smoothly move into the gap formed between the upper contact 14 and the lower contact 13, and the connecting leg 51 on the press rod 31 is separated from the resilient plate 9. Thus, the circuit formed by the first conductive plate 6 and the second conductive plate 16 is opened, and the neon lamp 4 turns off (not lighted). At this point, the interlinking rod 10 moves to the lowest position $P_1$, that is, it returns to the position as shown in FIG. 3A.

Figure 7A:
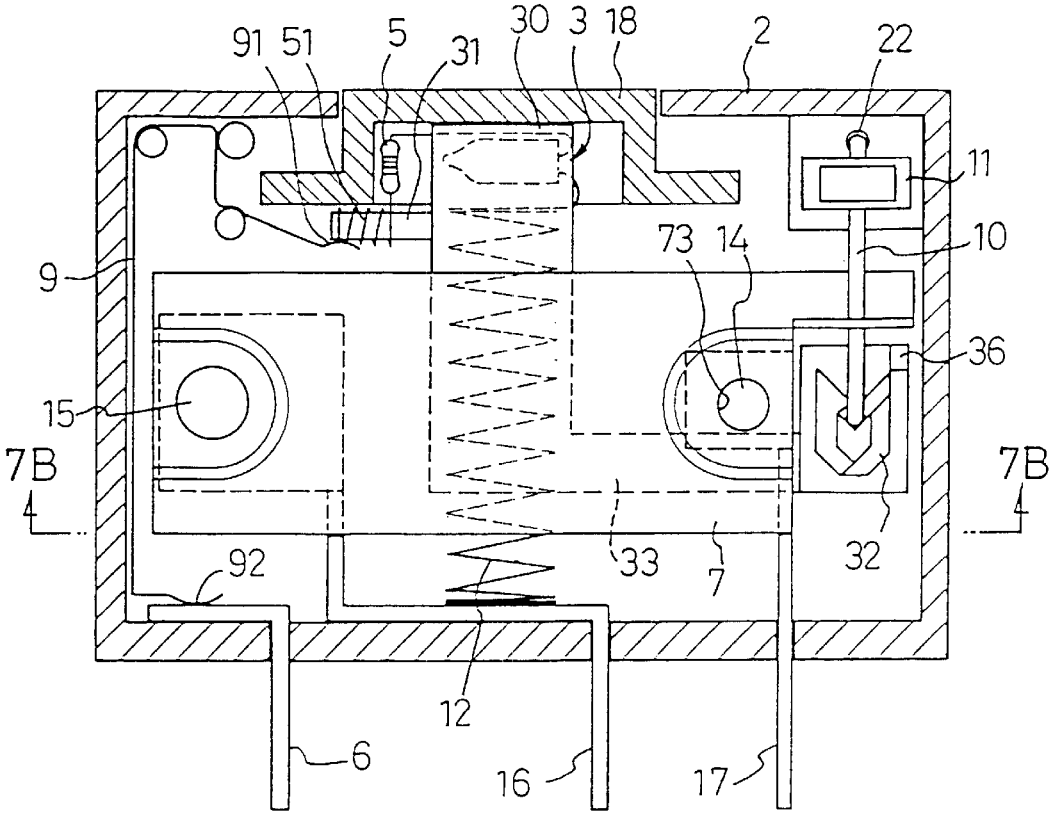
FIG. 7A is a schematic view illustrating the movement of the insulating element 33 due to the curving up of an alloy metal when the current exceeds a specified value in FIG. 5A.
Figure 7B:
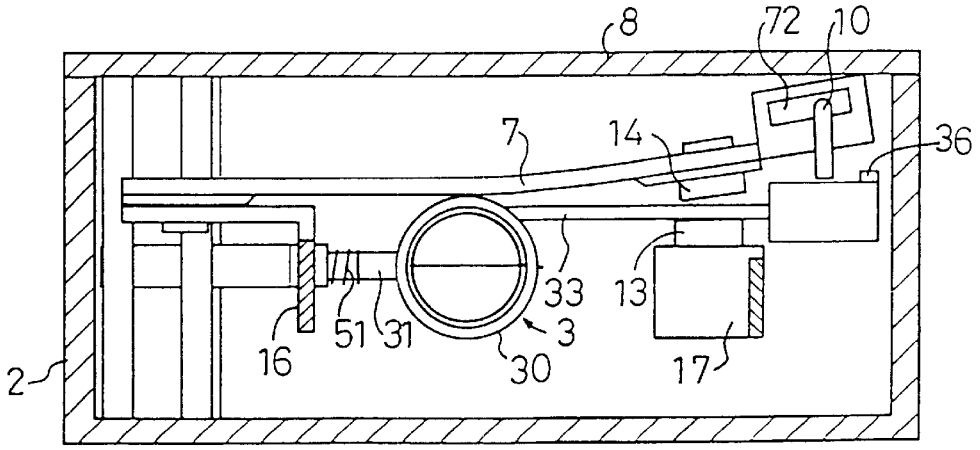
FIG. 7B is a cross-sectional view of the switch along line 7B—7B of FIG. 7A.

As shown in FIG. 7A, when the switch is in the "ON" position and the current to the switch exceeds a predetermined current value, the temperature of the alloy metal 7 is elevated. When the temperature of the alloy metal 7 is increased to a specific value, the alloy metal 7 will overcome the pressing force exerted by the leaf spring 11 and curves upward, and the lower end of the interlinking rod 10 (being engaged at the triangular passage 32) is lifted up by the square hole 72 of the alloy metal 7 (as shown in FIG. 7B) and dislocates itself from the restriction of the passage 32. The push rod 3 is pushed upward by the spring 12, and the insulating element 33 moves to position between the upper contact 14 and the lower contact 13. Thus, the circuit is opened and the objective to safely cut off the current is attained.

In accordance with the present invention, the alloy metal 7 having the above characteristics can be made from shape memory alloys, and the shape of the alloy metal is made in such a way that when the temperature is increased to a specific value, the alloy metal curves upwards. On the contrary, when the temperature is decreased to a specific value, the alloy metal restores to its original shape. Under this circumstance, the alloy metal 7 will corporate with the leaf spring 11 to urge the interlinking rod 10 back to the position before the alloy metal 7 curves up.

Figure 9A:
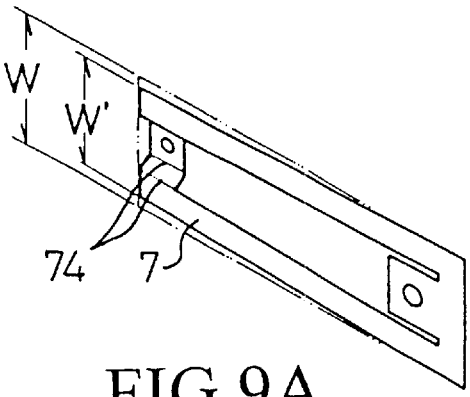
FIGS. 9A–9C are the various shapes of alloy metals of the present invention.
Figure 9B:
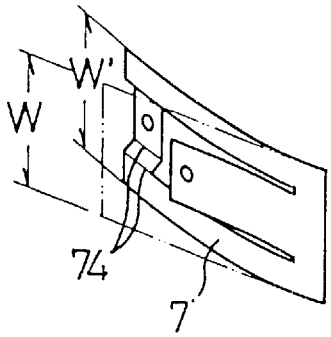
Figure 9C:
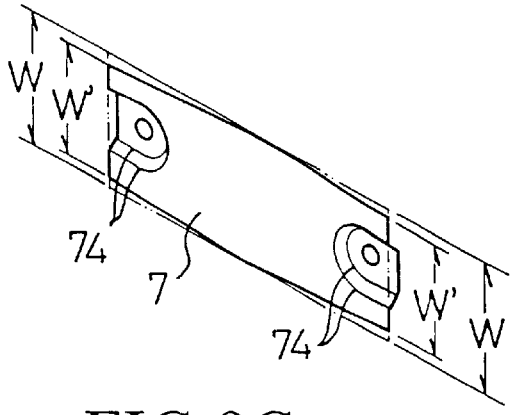

In order to attain the above objective, at least one end of the alloy metal 7 is fabricated to reduce its width. FIGS. 9A, 9B and 9C show the alloy metal of different shapes, wherein at least one end has a bent section 74 with a width W' which is smaller than the original width W. Thus, the alloy metal 7 will bend when the temperature reaches a specific value. While this invention has been particularly shown and described with reference to a preferred embodiment, it will be understood by those skilled in the art that various changes in the form and details may be made therein without departing from the spirit and scope of the invention as defined by the appended claims.

What is claimed is:

1. A push button current cut-off safety switch comprising:

a housing having an opening;

a push button mounted within the housing and being fitted to said opening;

a push rod being mounted below said push button and including a triangular passage and an insulating element;

a spring being inserted into and compressed by the push rod;

an interlinking rod having one end pivotally connected to the housing and the other end being connected to the triangular passage of the push rod;

a first conductive plate;

a second conductive plate being connected to the first conductive plate by a resilient plate such that the downward movement of the push rod electrically connects to the first and the second conductive plates and the upward movement of the push button disconnects the first and the second conductive plates;

an alloy metal made of a shape memory alloy which is thermally deformable, said alloy metal being linked to the second conductive plate and connected to the interlinking rod;

a third conductive plate being connected to the second conductive plate by the alloy metal; and whereby when the switch is at a closed circuit state and the current exceeds a predetermined current value, the alloy metal curves upward as a result of elevated temperature, and causes the interlinking rod to drive the insulating element to a position between the third conductive plate and the alloy metal.

2. The push button current cut-off safety switch as set forth in claim 1, wherein a neon lamp and a resistor are mounted between the first conductive plate and the second conductive plate as an indication of circuit status.

3. The push button current cut-off safety switch as set forth in claim 2, wherein the push rod comprises a press rod and a connecting leg of the resistor is linked to the press rod at one end, and is in contact with the first conductive plate when the push button is depressed.

4. The push button current cut-off safety switch as set forth in claim 3, wherein the first conductive plate is in contact with the connecting leg of the resistor by means of a resilient plate.

5. The push button current cut-off safety switch as set forth in claim 2, wherein the interior of the push rod is hollow to receive the spring, one end of the spring being connected to a connecting leg of the neon lamp, and the other end of the spring being connected to the second conductive plate.

6. The push button current cut-off safety switch as set forth in claim 1, wherein at least one end of the alloy metal is fabricated to reduce its width.

7. The push button current cut-off safety switch as set forth in claim 6, wherein the end section of the alloy metal is bent such that the width of the end section is smaller than its original width.

8. The push button current cut-off safety switch as set forth in claim 1, wherein the deformation of the alloy metal forces the interlinking rod to disengage the triangular passage.

* * * * *